US006509809B1

(12) United States Patent
Lynch

(10) Patent No.: US 6,509,809 B1
(45) Date of Patent: Jan. 21, 2003

(54) METHOD AND APPARATUS FOR COUPLING STRIP TRANSMISSION LINE TO WAVEGUIDE TRANSMISSION LINE

(75) Inventor: Jonathan J. Lynch, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 39 days.

(21) Appl. No.: 09/650,316

(22) Filed: Aug. 29, 2000

Related U.S. Application Data

(63) Continuation of application No. PCT/US00/14748, filed on May 26, 2000, and a continuation-in-part of application No. 09/322,119, filed on May 27, 1999, now Pat. No. 6,127,901.

(51) Int. Cl.[7] ..... H01P 5/107
(52) U.S. Cl. ..... 333/26; 333/34
(58) Field of Search ..... 333/26, 34, 246

(56) References Cited

U.S. PATENT DOCUMENTS 6,127,901 A * 10/2000 Lynch ..... 333/26
6,144,266 A * 11/2000 Heidemann et al. ..... 333/26

FOREIGN PATENT DOCUMENTS

| | | |
|---|---|---|
| DE | 42 41 635 | 6/1994 |
| DE | 44 41 073 | 1/1996 |
| EP | 0 599 316 | 6/1994 |
| JP | 07 202520 | 12/1995 |
| JP | 08 148913 | 10/1996 |

* cited by examiner

*Primary Examiner*—Benny Lee
(74) *Attorney, Agent, or Firm*—Ladas & Parry

(57) ABSTRACT

A strip transmission line to waveguide transmission line transition or impedance coupling is described. A strip transmission line is separated from a ground plane by a dielectric therebetween, and an aperture is formed through the ground plane and the wall of a waveguide transmission line on the other side of the ground plane (ground plane and wall may be the same piece). Each transmission line is terminated reactively, or at a port; for simple coupling across the transition, one end of each transmission line forms a reactive stub termination, such as an open circuit end. A waveguide channel waveguide walls and a waveguide base connected therebetween may be provided. The walls of such waveguide are coupled with the ground plane to provide a waveguide top for the waveguide transmission line. An aperture is located, preferably transverse to the microstrip transmission line, and passes through an opening in the ground plane and also through a coupled waveguide side, which may be separate or of a piece with the ground plane. The impedances of the transmission lines are adjusted to affect the coupling afforded by the aperture. Multiport impedance coupled transmission lines may be formed in this way.

32 Claims, 8 Drawing Sheets

METHOD AND APPARATUS FOR COUPLING STRIP TRANSMISSION LINE TO WAVEGUIDE TRANSMISSION LINE

RELATION TO PRIOR COPENDING APPLICATIONS

This application is a continuation of copending PCT application Ser. No. PCT/US00/14748, filed May 26, 2000, which PCT application designates the United States, the disclosure of which is hereby incorporated herein by this reference; this application is so a Continuation in Part of application U.S. Ser. No. 09/322,119, filed May 27, 1999, now U.S. Pat. No. 6,127,901, the disclosure of which is also hereby incorporated herein by this reference.

FIELD OF THE INVENTION

This invention relates to the field of electromagnetic wave energy transmission, and, more particularly, to a method and apparatus for coupling electromagnetic energy from a strip transmission line to a waveguide transmission line in a structure that is well suited to both a wide range of functionality and to very low cost production.

BACKGROUND OF THE INVENTION

In the field of microwave and millimeter wave energy transmission, such as commercial automotive radar systems (e.g. DE/Delphi's 77 GHz Forward Looking Radar), a myriad of microwave or millimeter wave components are involved, including millimeter integrated circuits (MMICs), diodes, printed circuits, antennas, and possibly waveguide components such as voltage-controlled oscillators (VCOs) and isolators. Most of the components utilized are typically mounted on planar microstrip transmission line circuits since this method is extremely low cost. However some components, such as antennas, may be more preferably compatible with waveguide transmission lines instead of microstrip transmission lines. Therefore, when microstrip transmission lines are used in conjunction with waveguide transmission lines, there is a need for an effective way to transfer transmitted wave energy between the microstrip transmission line and the waveguide transmission line without serious return loss and insertion loss degradation.

One method for designing microstrip to waveguide transitions is to use probes to couple energy to and from the waveguide. However, at very high frequencies (such as 77 GHz) probes are very tiny and difficult to handle in a high volume manufacturing environment. Manufacturing tolerance errors can cause serious return loss and insertion loss degradation.

For example, one prior art coupling technique is known as a probe launch. A circuit board (e.g., a DUROID™ board) is cut back so that a tab having a microstrip transmission line which runs to the end of the tab, is inserted into the waveguide. The typical circuit board ground plane is cut away below the microstrip transmission line protruding into the waveguide so that the insulator portion of the board supports the "stick out" tab portion of the microstrip transmission line as a probe. The cutaway circuit board is placed into a waveguide opening, thereby creating a probe launch into the waveguide. However, the difficulty with such an approach is the ability to manufacture and assemble the components in a high volume manufacturing environment. It is somewhat difficult to cut the circuit board to make the microstrip probe and then slip the cut board into the waveguide structure such that there is good contact between the ground of the circuit board and the waveguide wall. Also, it should be noted that the waveguide opening where the circuit board is inserted must be carefully controlled so that the probe does not short circuit against the waveguide wall. As such, those skilled in the art can appreciate that the whole manufacturing and assembly procedure involved with providing a mechanically and electrically stable microstrip probe end launch is not straightforward.

Another similar probe launch technique also involves a microstrip transmission line on a circuit board (e.g. a DUROID™ board), where at an end point along the microstrip transmission line there are a series of vias in a rectangular pattern around the end point and through the circuit board and connecting with the typical circuit board ground plane. The rectangular pattern of vias conduct all the way to the ground plane. A waveguide back short then connects with the vias at the ground plane and waveguide walls are formed perpendicular to the circuit board at the end point so that a microstrip to waveguide transition is formed. This approach allows such end launching to be formed in the middle of a board rather than at the end as described previously with the cut board and "stick out" tab probe. This approach also requires having a sizeable opening in the waveguide which can produce unwanted leakage radiation. While this latter approach may be somewhat simpler to accomplish than the former cut board approach, similar manufacturing control problems as previously described still exist.

There is, therefore, still a need for an efficient, cost effective method and apparatus for coupling microwave or millimeter wave frequency range energy from a microstrip transmission line to a waveguide transmission line. The present invention provides such a microstrip to waveguide transition whose simple assembly makes it ideal for high volume manufacturing.

Moreover, such coupling methods and apparatus are not limited to microwave and higher frequencies, but are valuable and applicable for all manner of strip transmission line coupling to waveguide transmission lines.

SUMMARY OF THE INVENTION

In accordance with the present invention a method and apparatus for coupling one or more strip transmission lines to a waveguide transmission line is provided. One or more strip transmission lines are separated from corresponding ground planes by a dielectric therebetween. Each transmission line may be terminated reactively, or may form a port having a substantially resistive impedance. The waveguide transmission line is positioned on the opposite side of the corresponding ground plane from the conductive strip of the strip transmission line, and an aperture is formed through both the waveguide wall and the corresponding ground plane of the strip transmission line. This aperture will disrupt the transmission field of the two transmission lines involved, causing energy to be coupled between them.

By employing n apertures coupling the one or more strip transmission lines to the waveguide, an impedance-coupled network may be formed having up to 2(n+1) ports.

A waveguide having at least one waveguide wall is provided. The waveguide may be a channel, having waveguide walls and a waveguide short circuit wall located along the channel, but may take other forms (e.g. rectangular or round). For channel waveguides, the waveguide walls may have a narrow dimension, and may be coupled directly to the ground plane, which then provides a broader dimension top waveguide wall for the channel waveguide transmission line.

An aperture is located (typically transverse to the microstrip transmission line) and forms an aperture ground plane opening in the ground plane. The aperture is located proximate to the strip transmission line, and may typically be within one-half wavelength (of an operating frequency center) of a reactively terminated end, such as an open circuit end, which provides a strip transmission line circuit stub. The aperture may also be located proximate to a waveguide reactive termination, which provides a waveguide transmission line circuit stub. In a preferred embodiment a microstrip transmission line substrate is bonded to a conductive block using a conductive adhesive. The conductive block has a channel which forms three of the four waveguide transmission line walls. The ground plane of the microstrip substrate forms the upper waveguide transmission line wall. Transmitted wave energy is coupled between the microstrip transmission line and the waveguide transmission through the aperture etched in the microstrip ground plane of the substrate. The aperture is located less than a quarter-wavelength at the operating center frequency from the microstrip transmission line open circuit end and less than a quarter-wavelength at the operating center frequency from the waveguide short circuit wall.

DETAILED DESCRIPTION OF THE INVENTION

Figure 1:
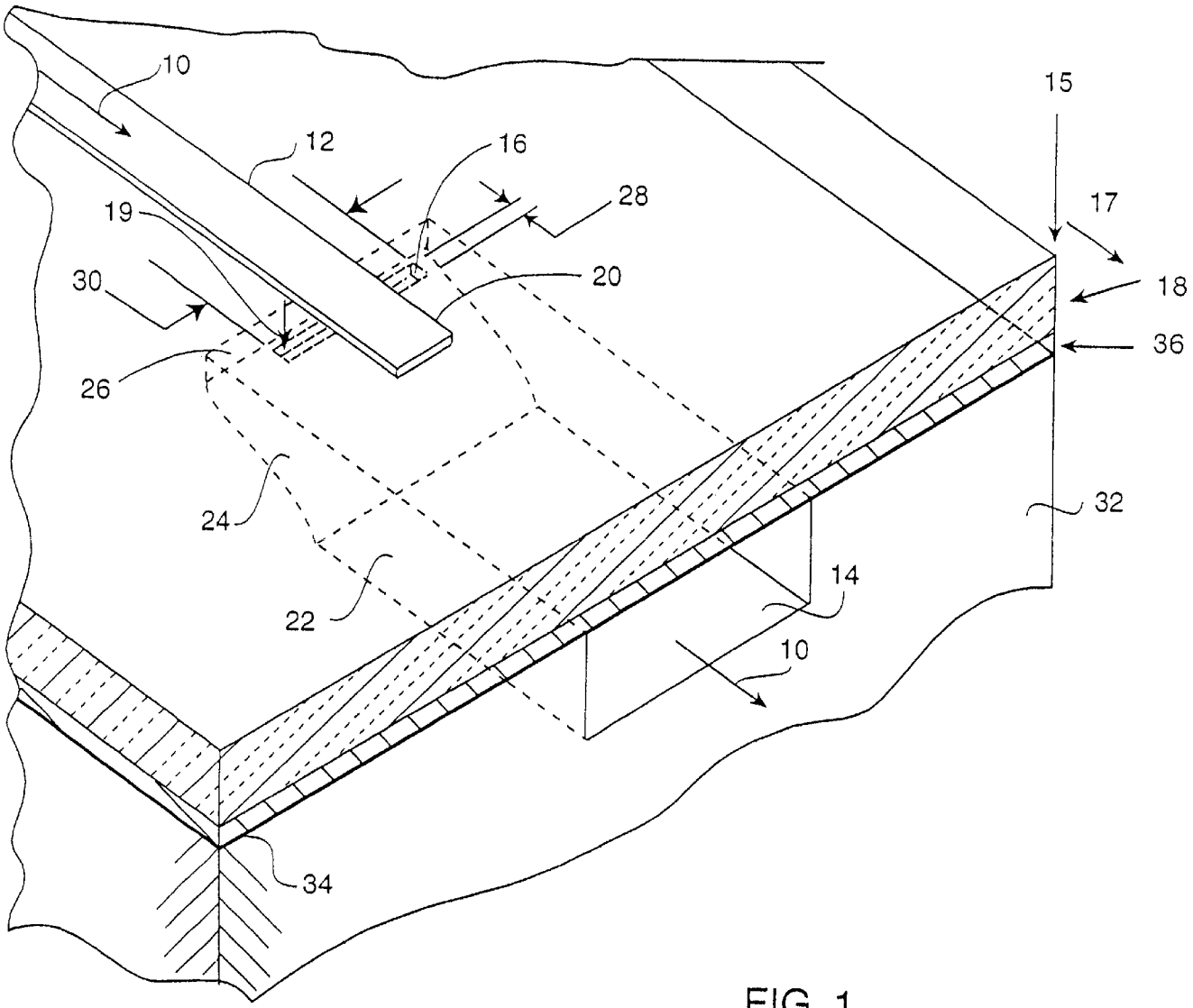
FIG. 1 shows a perspective schematic view of an embodiment of the invention.

Various embodiments of the invention are depicted in the drawings discussed below. Reference numbers are used to depict designated elements shown in the drawings. The same part of an embodiment appearing in more than one drawing is always designated by the same reference number. Also, the same reference number is never used to designate different parts.

Referring to FIG. 1, microwave or millimeter wave energy (power) 10 flows along microstrip transmission line 12 and is desired to be coupled to and flow in waveguide 22, which, for illustration purposes, has a depicted rectangular cross-section 14, such as for a WR-10 waveguide. (It should be noted, however, that in FIG. 1, flow 10 in waveguide 22 is shown at a sectioned edge 15 merely for illustration clarity purposes. Those skilled in the art can appreciate that waveguide 22 does not come to an abrupt stop at edge 15 but typically can extend along direction 17 as desired or required by the waveguide transmission line circuit.) An aperture 16 is etched through the backside microstrip board ground plane 36 on the opposite side of the board with respect to microstrip transmission line 12 (e.g., through the ground plane of an Arlon ISOCLAD® 917 board, 0.005" (125 $\mu$m) thick, ½ oz. (15 g) Cu). An open circuit stub 20 proximate to aperture 16 is formed by an abrupt end of the microstrip transmission line. Aperture fields are excited as the power comes along the microstrip transmission line and encounters the aperture. A waveguide short circuit stub 26 is formed in the waveguide proximate to the aperture opening in the microstrip ground plane 36. Power, depicted schematically as direction arrow 19, couples through aperture 16 and into waveguide 22, with the open circuit and short circuit stubs being situated to effectively electrically cancel each other out as described in more detail below. The waveguide has a taper from the aperture area to the full-height standard waveguide (e.g., WR-10). Taper 24 is provided to help compensate for impedance mismatches in the aperture area. For example, the microstrip impedance is in the order of 50–80 ohms or so, while the standard waveguide impedance in the area of hundreds of ohms. The gradual taper is used to go from the high waveguide impedance to the lower microstrip impedance. The type of taper is not critical, e.g., it can be a linear taper or, in a preferred embodiment, a curved taper, which minimizes the amount of curvature along the length of the taper. Of course, those skilled in the art can appreciate that the longer the taper, the better. However, the length of the taper is a tradeoff between the amount of space available for the taper and the amount of impedance mismatching which can occur. In the preferred embodiment, a 0.2" (5 mm) long taper was chosen, with a gradual tapering from a full height narrow WR-10 wall of 0.050" (1.25 mm) to a reduced height narrow wall at the waveguide short circuit stub of 0.010" (254 $\mu$m). In the preferred embodiment, a tapered curve was chosen based upon minimizing the mean square value of the second derivative of the waveguide height as a function of distance along the waveguide.

Figure 2A:
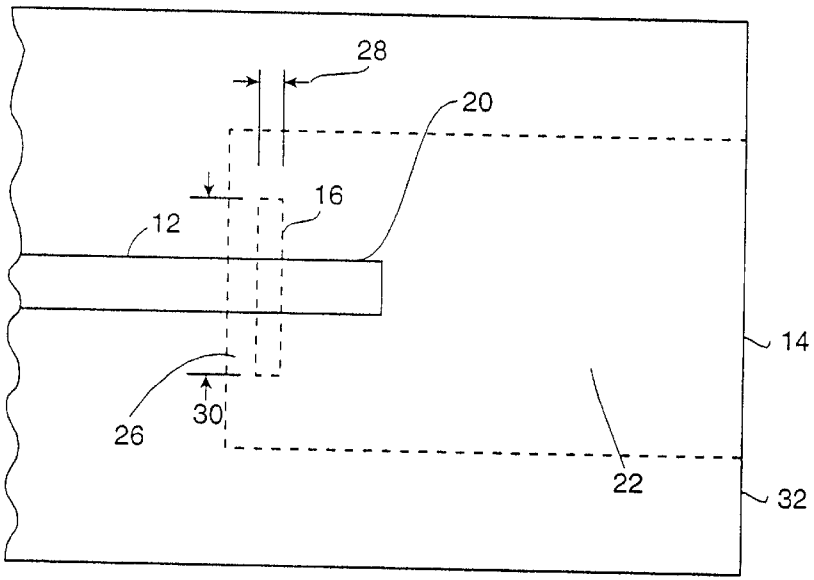
FIG. 2A is a top plan view of the embodiment depicted in FIG. 1.
Figure 2B:
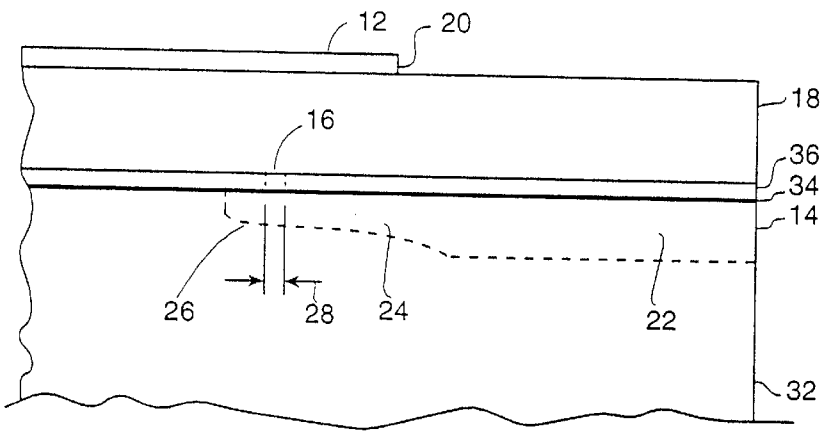
FIG. 2B is a side plan view of the embodiment depicted in FIG. 1.
Figure 2C:
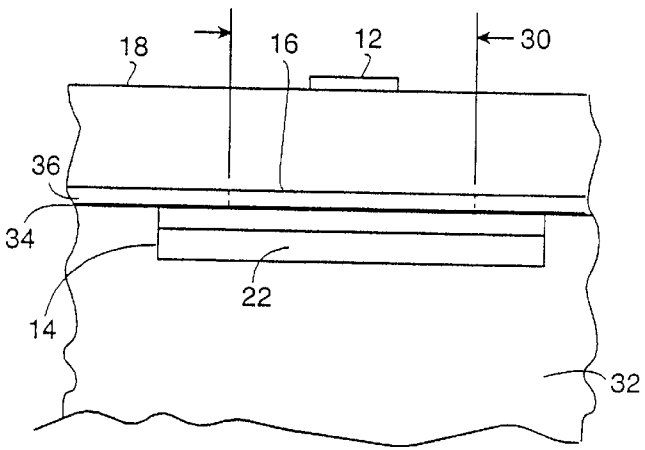
FIG. 2C is a front plan view of the embodiment depicted in FIG. 1.

FIGS. 2A, 2B, and 2C are provided to depict other views of the embodiment shown in FIG. 1 to further illustrate this embodiment of the invention. Specifically, FIG. 2A shows a top plan view of the embodiment depicted in FIG. 1. FIG. 2B shows a side plan view of the embodiment depicted in FIG. 1. FIG. 2C shows a front plan view of the embodiment depicted in FIG. 1.

To provide a good impedance match, the length of the open circuit microstrip stub 20 and the length of the short circuit waveguide stub 26 become important. In the preferred embodiment, waveguide stub (back short) 26 is made smaller than a quarter wavelength at the center frequency in the device operating frequency range (e.g., at 80 GHz in the device operating frequency range of 75 GHz–85 GHz) and looks like an inductive reactance so that an inductance is provided at the junction. Open circuit microstrip stub 20 is similarly made smaller than a quarter wavelength at the center frequency in the device operating frequency range and looks capacitive. As such, the net inductance and capacitance of the stubs and other junction effects can be canceled out.

Width 28 of aperture 16 is not significant, other than it being narrow as compared to a wavelength. Length 30 of the slot is spaced equidistant about transmission line 12 and should be roughly half a wavelength at the center frequency in the device operating frequency range using the effective dielectric constant in the aperture which is typically the average of the dielectric material and air, since aperture slot 16 includes both air of the waveguide and dielectric of the board. Then, to effectively adjust the matching impedance, those skilled in the art can take into consideration the aperture slot reactance and dimensional characteristics and appropriately adjust the open circuit microstrip stub length and/or the waveguide back short length to maximize the return loss and minimize insertion loss.

Figure 3:
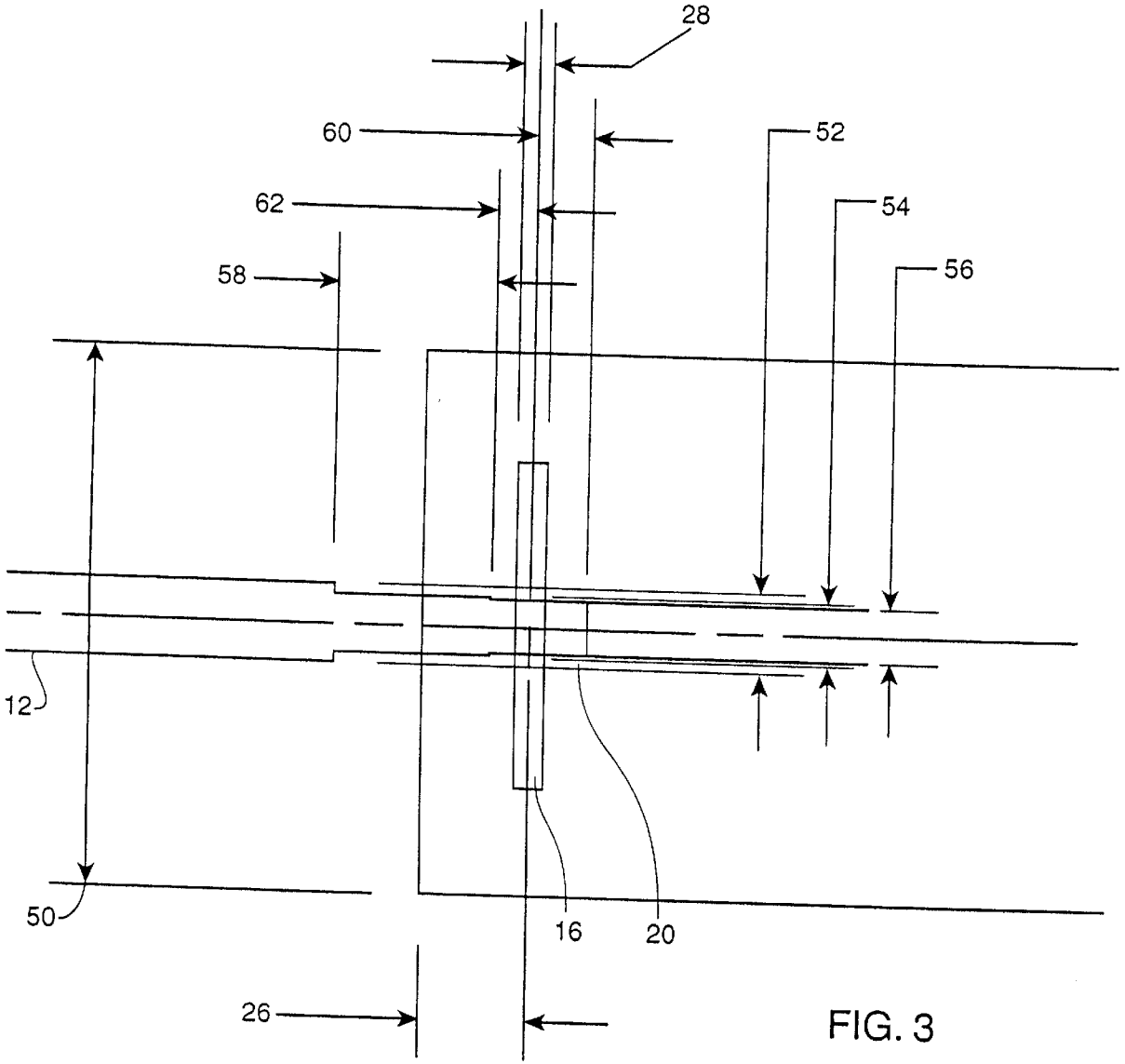
FIG. 3 shows schematic top plan view of various key dimensions of a preferred embodiment of the present invention.

Referring to FIG. 3, a schematic top plan view of various key dimensions of a working preferred embodiment of the present invention operating with WR-10 waveguide in a frequency range of 75–85 GHz is illustrated. Reference numerals consistent with aspects depicted in FIGS. 1 and 2A–2C are similarly numbered. Inner waveguide dimension 50 is 0.100". Microstrip 12 is located on an Arlon ISO-CLAD® 917, 0.005" (125 $\mu$m) thick, ½ oz. (15 g) Cu board and has an initial strip width 52 of 0.0148" (376 $\mu$m) and two transition steps 54 and 56 of 0.0105" (267 $\mu$m) and 0.010" (254 $\mu$m) respectively. Transition step 54 has a step length of 0.029" (737 $\mu$m). Aperture width 28 is 0.005" (125 $\mu$m) and is located such that waveguide back short 26 is 0.020" (0.51 mm). Open circuit stub 20 has an end distance 60 from aperture 16 of 0.010" (0.254 mm) and has its junction distance 62 to the step 54/step 56 transition of 0.007" (0.178 mm).

Referring back to FIG. 1, to manufacture the transition, in a preferred embodiment, a block 32 is used to support microstrip circuit board 18. Block 32 can be aluminum machined or cast to have groove(s) or channel(s) in it, which form two of the narrow walls of the waveguide along with a broad wall of the waveguide connecting the two narrow walls. WR-10 is the size of the waveguide to be formed in the preferred embodiment.

Microstrip board 18 is etched such that on one side there are microstrip transmission lines, while on the other side there are aperture(s) 16 located in ground plane 36 in relationship with the microstrip transmission line being coupled. The etching process is standard wherein double-clad board is patterned on both sides such that the unwanted copper is etched away on both sides of the board.

A thin sheet of conductive adhesive 34, such as Ablestick (trademark) 5025E conductive epoxy, has appropriate openings cut into it. The adhesive is then laid onto the block area and the circuit board ground plane area is placed on top of the adhesive. Alignment pins may be used to align the adhesive and circuit board etchings with the grooves in the block. The alignment precision is kept on the order of +/−0.001" (25 $\mu$m). A temporary top plate, such as a hard plastic can be then placed on the circuit board to apply pressure and flatten the adhesive and provide a good bond between the circuit board ground plane (which will form the top of the waveguide when assembly is complete) and the block. The assembled unit is then heated in an oven to melt the conductive adhesive to form a good bond between the circuit board and the metal block and therefore good current conductivity. The Ablestick openings help prevent the adhesive adding additional loss to the top surface of the waveguide. The temporary top plate can then be removed and an appropriate permanent cover affixed to protect the microstrip circuits and any components (e.g., planar surface mounted Gunn diode oscillators) which may be mounted thereon.

Figure 5:
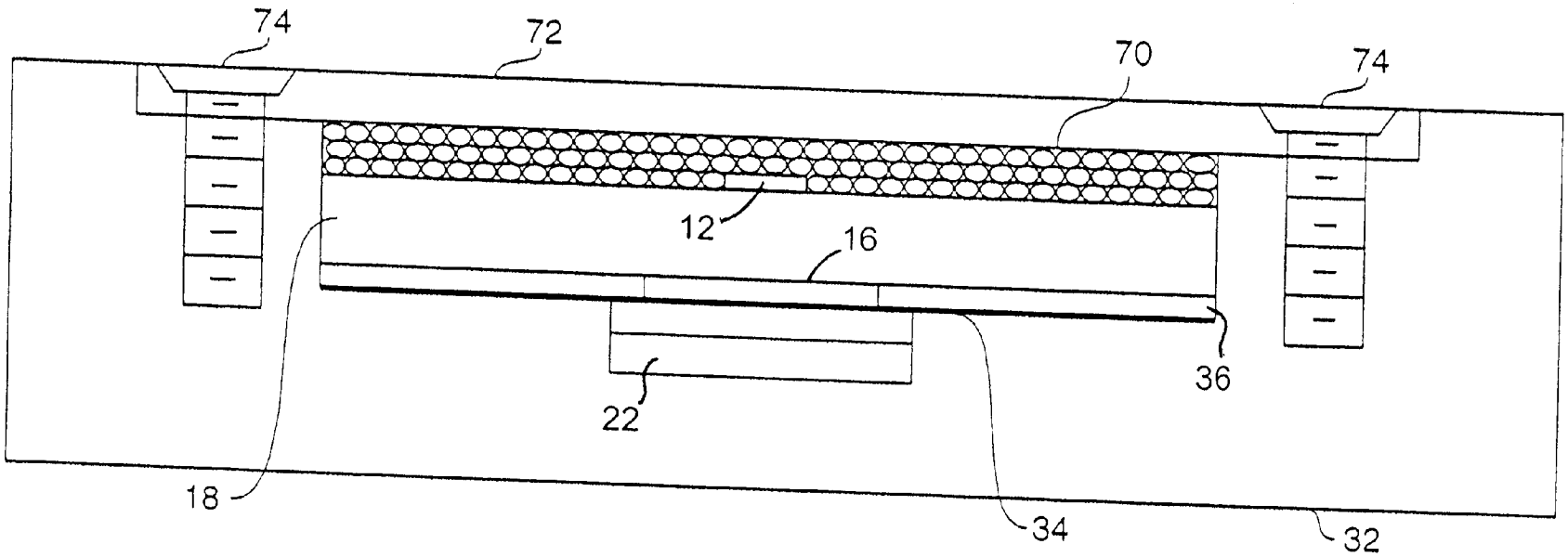
FIG. 5 shows a front plan view of any alternative embodiment.

In another embodiment, referring to FIG. 5, foam 70 (made of appropriate dielectric material for the microstrip transmission purposes) can be used between aluminum top plate 72 wherein screws 74 fasten top plate 72 with block 32, adhesive 34, ground plane 36, etched circuit board 18, and foam 70 being sandwiched therebetween. In some applications, the use of foam is preferred in that it can be easily cut to accommodate chips and the like which are connected to the microstrip transmission line circuits.

Another advantage of the transition in accordance with the present invention is that the waveguide runs essentially in the same plane as the microstrip circuit, whereas in the prior art, typical transitions run such that the resulting transmission lines are perpendicular to each other. The present invention thus enables transmitted wave paths to be generally maintained in the same plane, particularly where there is not much vertical thickness space available.

Figure 4B:
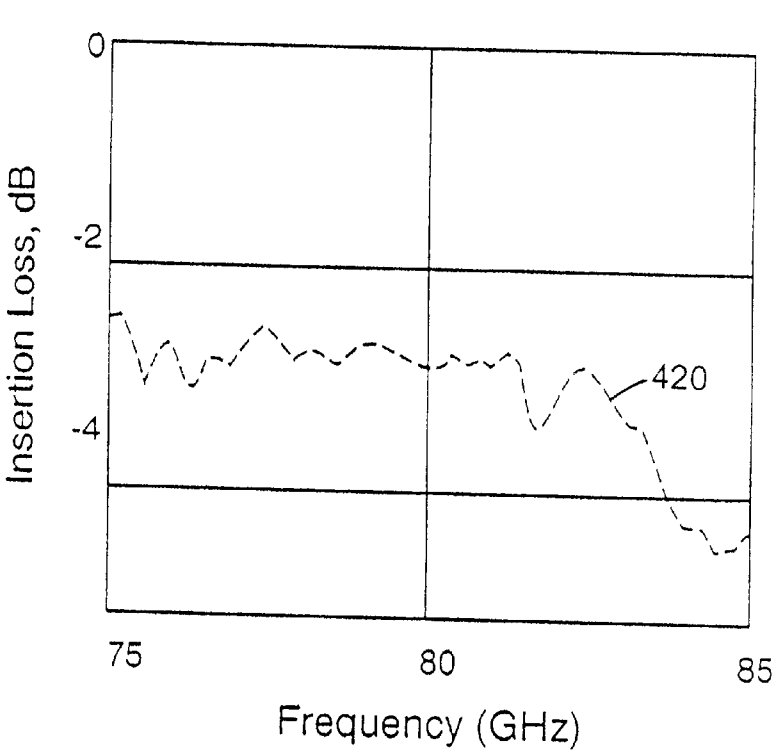
FIG. 4B is a graph showing measurements of Insertion Loss in dB vs. Frequency in GHz taken for a preferred embodiment of the invention.
Figure 4A:
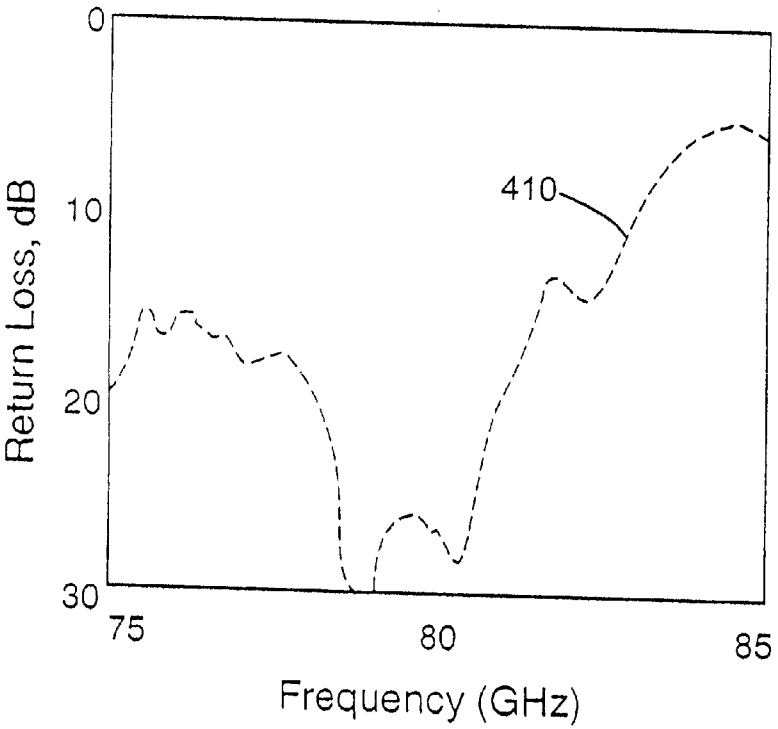
FIG. 4A is a graph showing measurements of Return Loss in dB vs. Frequency in GHz taken for a preferred embodiment of the invention.

Referring to FIG. 4A, there is shown a graph depicting measurements of Return Loss in dB vs. Frequency in GHz taken for two similar back to back (i.e., waveguide to microstrip to waveguide) transitions of a test device having the dimensions identified above with regard to FIG. 3. The line 410 shows the measured return loss over the indicated frequency. range.

Similarly, FIG. 4B is a graph showing measurements of Insertion Loss in dB vs. Frequency in GHz taken for the two back to back (i.e., waveguide to microstrip to waveguide) transitions for the test device having the dimensions identified above with regard to FIG. 3 and the Return Loss measurements of FIG. 4A. The dashed line 420 shows the measured insertion loss over the indicated frequency range.

Figure 6B:
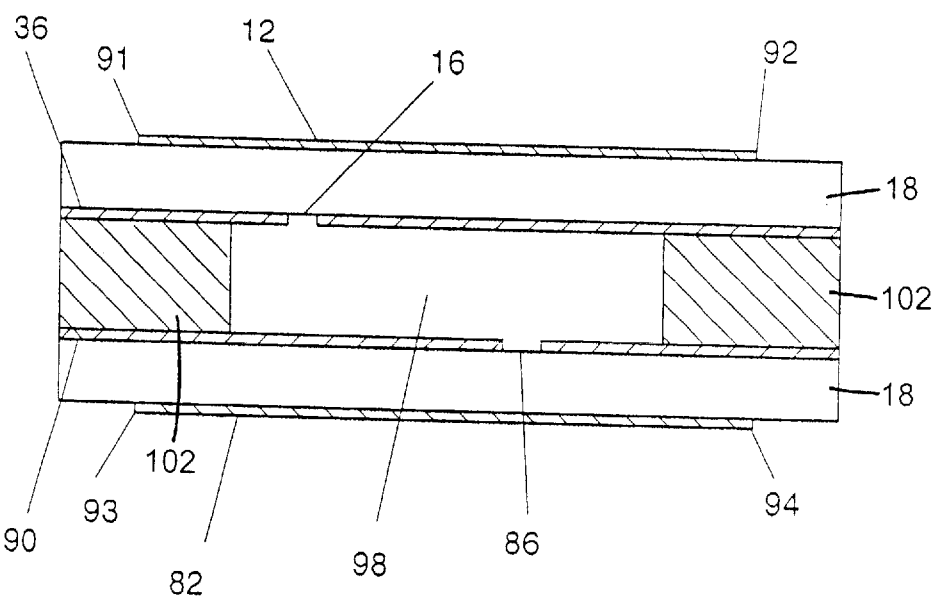
FIG. 6B is a side view of the subject of FIG. 6A, with four ports visible.
Figure 6A:
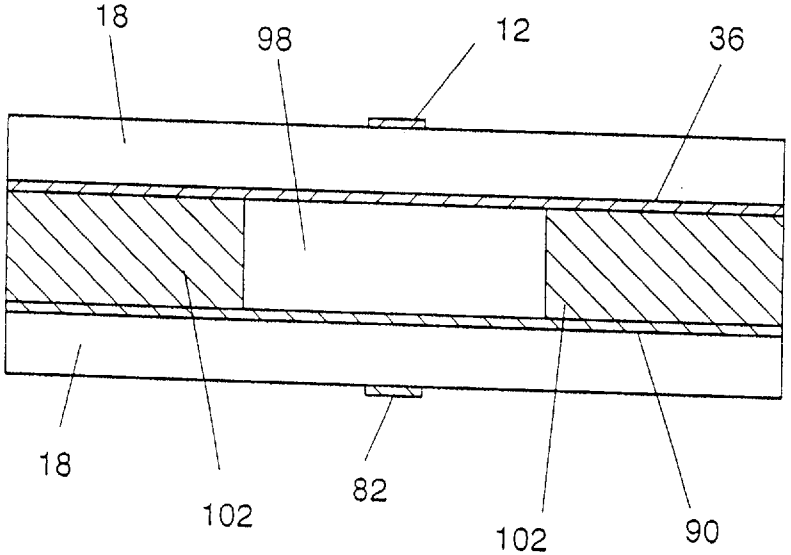
FIG. 6A is an end view of two strip transmission lines coupled to a resonant cavity.

FIGS. 6A (end view) and 6B (side view) show strip transmission lines formed of conductive strips 12, 82 disposed above a corresponding ground plane 36, 90 with dielectric 18 therebetween. This need not be microwave or millimeter wave transmission line, but may be any wavelength, as long as the materials and dimensions are selected to match the wavelength. Lateral walls 102 of resonant cavity 98 are shown with substantial material, but of course may be simply walls of minimal thickness. Top and bottom walls of resonant cavity 98 are shown as being formed by ground planes 36, 90 of the strip transmission lines. However, it is to be noted that satisfactory coupling for some purposes may be achieved when the strip transmission line ground plane is less tightly coupled to the resonant cavity (or other waveguide). For example, the ground plane of one or more of the strip transmission lines may be separated in one or more places by as much as one tenth of a wavelength (of a center of an operating frequency range) from the wall of the waveguide, in the vicinity of the apertures. However, tighter coupling between strip transmission ground plane 36, 90 and the waveguide (here, resonant cavity 98) is desirable, preferably at least ohmic contact, conductive adhesive bonding, or, as shown, utilizing the same metal.

Coupling is achieved by apertures 16, 86 which penetrate the coupled transmission line ground plane proximate to strip 12, 82 of the upper and lower strip transmission lines. The shape of the apertures 16, 86, shown as rectangular, may be made as desired. The shape will affect the impedance of the coupling between the waveguides. In these FIGS. 6A and 6B, the upper strip transmission line has port terminations 91 and 92, while the lower strip transmission line has port terminations 93 and 94. With coupling through the resonant cavity, a four port impedance-coupled network is effected.

Figures 7A, 7B:
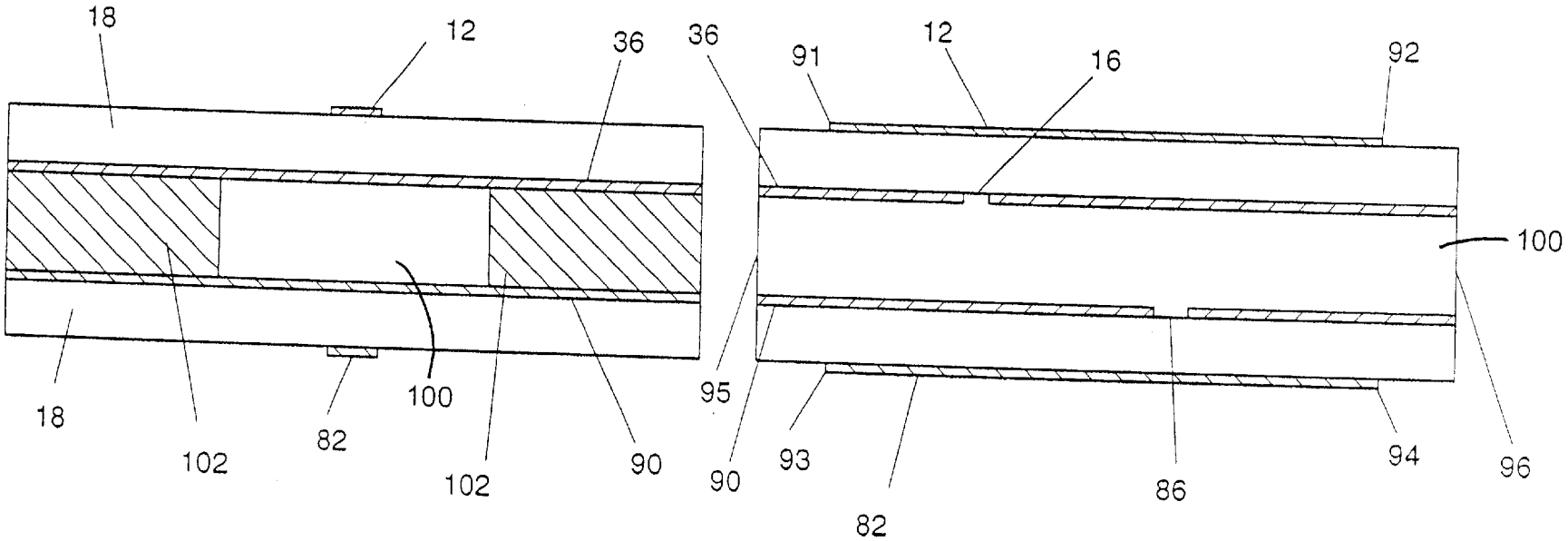
FIG. 7A is an end view of two strip transmission lines coupled to a waveguide.
FIG. 7B is a side view of FIG. 7A, with six ports of a network visible.

Four port coupling may also be achieved, for example, with a waveguide coupled to a strip transmission line through a single aperture, if all four ends of the two transmission lines are port terminated, instead of being reactively terminated. Indeed, a six port network is shown in FIGS. 7A (end view) and 7B (side view). There, the top strip transmission line is port terminated at ports 91 and 92, while the bottom strip transmission line is port terminated at 93 and 94. Further, waveguide 100 itself is port terminated at ports 95 and 96. As can be seen, then, the present invention may be practiced to form impedance-coupled waveguides having an unlimited number of ports. Nor must the coupling between the strip transmission lines and the waveguide be limited to a single aperture 16 or 86 as shown, but a plurality of such apertures may create impedance couplings between even the same strip transmission line and waveguide.

The shape of apertures 16, 86, the coupling between the waveguide wall and the strip transmission line ground plane around the aperture, and the shape of the waveguide and of the strip transmission line may all be used to establish a desired impedance coupling between the transmission line and the waveguide. As discussed with respect to FIGS. 6A and 6B, the coupling may range from utilizing the same metal (as shown), to an ohmic contact such as a conductive adhesive, to even a separation of up to a tenth of a wavelength between the waveguide wall and the ground plane (as long as there is substantial conductivity at the operating frequency). However, a common use of the present invention will be to couple as much power as possible between the waveguide and the strip transmission line. To do so, one end of each transmission line is reactively terminated at some distance from an aperture, so that the impedance at the aperture is approximately zero. Thus, if an open circuit stub is used, then a quarter wavelength distance of termination to aperture is appropriate; while if a short circuit stub is used, then the stub should extend a half wavelength past the aperture. (Note, however, that the transmission lines may be terminated farther away, e.g. 1.25 wavelengths away, as long as the net reflected impedance is conducive to causing coupling through the aperture.) When transmission lines are coupled according to the present invention, the apertures are shaped and the transmission lines are terminated as described in detail with regard to FIGS. 1 to 3, coupling can be achieved having losses of less than one tenth of a dB. Thus, the present invention offers truly low-loss, as well as low-cost, transmission line coupling.

Figures 8A, 8B:
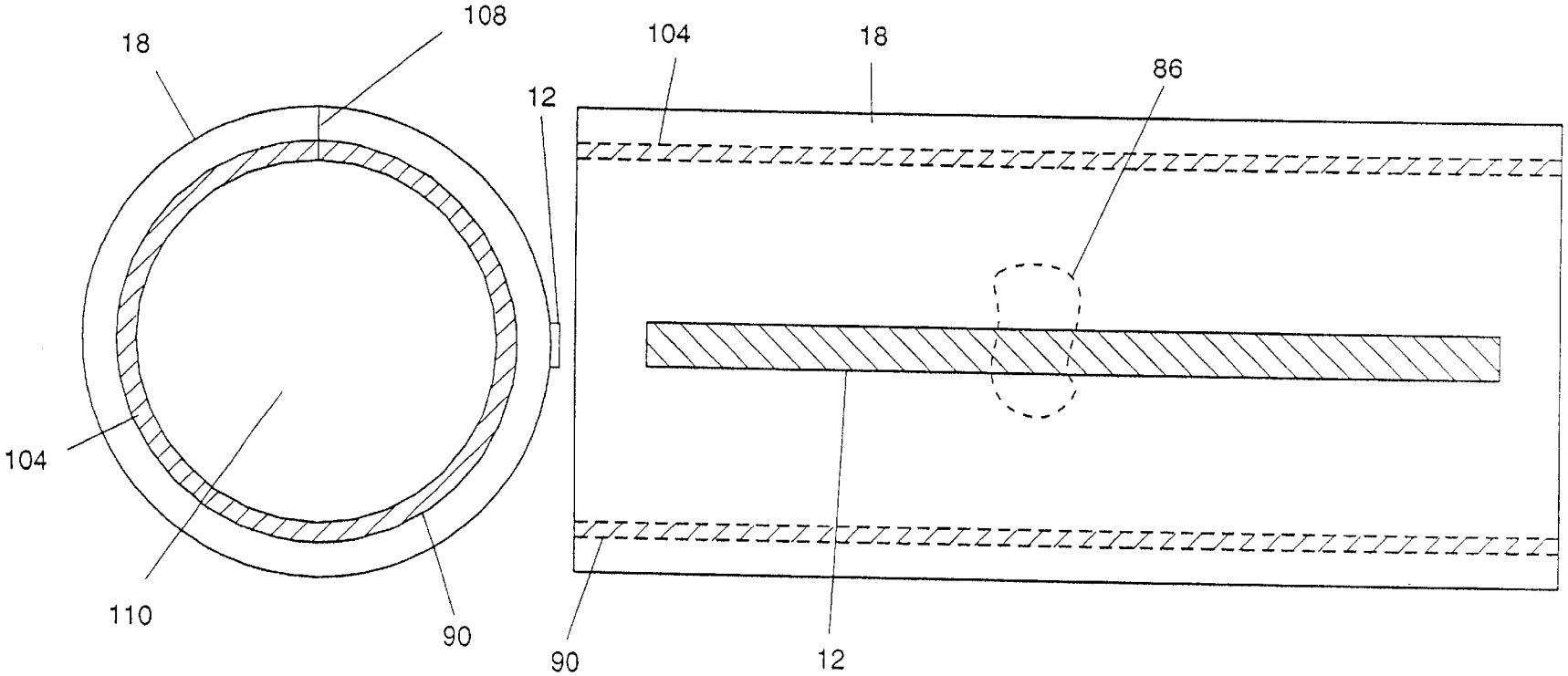
FIG. 8A is an end view of a strip transmission line coupled to a circular waveguide.
FIG. 8B is a side view of the subject of FIG. 8A.

FIGS. 8A and 8B show an embodiment of the present invention employing a round waveguide. Of course, the waveguide may take other shapes as well. Dielectric 18 is wrapped around wall 104, which is the same as ground plane of the strip transmission line having conductive strip 12 separated from wall 104 by dielectric 18. As above, the strip transmission groundplane must be conductively connected to the waveguide around aperture 86, but it need not be identical, nor even ohmically in contact thereto. However, ohmic contact such as conductive adhesive bonding, or identity of material, is generally preferable for most purposes. Aperture 86, as shown in FIG. 8B, clearly shows the arbitrary shape of such an aperture, which may be varied as needed to achieve the desired impedance of the coupling.

Alternatives to the preferred embodiment will be apparent to those skilled in the art. For example, the aperture need not be perpendicular to the microstrip transmission line. However, in non-preferred embodiments not as much power will be coupled. The aperture could be offset from the conductor, providing the same general effect, but with a slightly different impedance transformation, which can be compensated for by the adjustments in the open circuit and back short stubs. However, maximum coupling is achieved when the microstrip transmission line is perpendicular to the aperture slot and the aperture slot is, in turn, perpendicular to the waveguide. Deviations from this configuration will reduce the amount of coupling and necessitate additional impedance matching.

Preferred embodiments and alternative embodiments are disclosed herein for illustration of the present invention, but are not to be used to limit the scope of the invention. Rather, the invention is defined by the claims which follow.

What is claimed is:

1. A method for coupling a strip transmission line to a waveguide transmission line, comprising the steps of:

providing a strip transmission line having a conductive strip separated from a corresponding ground plane by dielectric therebetween;

creating an opening through the ground plane at a location proximate to the conductive strip;

providing a waveguide having a waveguide wall and an opening therethrough; and connecting the ground plane to within less than one tenth wavelength of an operating frequency center of the waveguide wall substantially around said waveguide opening and around said ground plane opening, thereby forming an aperture through both the waveguide wall and the ground plane.

2. The method of claim 1, wherein the waveguide wall is part of the ground plane at least adjacent to the aperture.

3. The method of claim 1, wherein the step of creating an opening through the ground plane includes creating a plurality of such openings through one or more ground planes;

the step of providing an opening through the waveguide includes providing a plurality of such openings through one or more walls of the waveguide corresponding to the plurality of openings through-the one or more ground planes; and the step of connecting the ground plane to within less than one tenth wavelength of an operating frequency center of the waveguide wall substantially around said waveguide opening includes similarly connecting each waveguide opening and the corresponding ground plane openings, thereby forming a plurality of apertures each passing through both the waveguide wall and the corresponding ground plane.

4. The method of claim 3, wherein the step of providing a strip transmission line includes providing a plurality of conductive strips separated from one or more ground planes by dielectric therebetween; and at least one aperture of said plurality of apertures is formed proximate each conductive strip.

5. The method of claim 1, further including the steps of terminating an end of each strip transmission line and terminating an end of the waveguide.

6. The method of claim 1, further including the step of positioning each aperture within one-half wavelength of an operating frequency center from a termination of the proximate strip transmission line or within one-half wavelength of a termination of the waveguide.

7. The method of claim 1, wherein the wave guide provided is rectangular in cross section, the strip transmission line provided is microstrip transmission line, and wherein at least one wall of the waveguide is substantially mated with or part of the ground plane of the microstrip transmission line.

8. The method of claim 1, wherein the waveguide provided is substantially round, and including the further step of mating the waveguide to the strip transmission line ground plane at each aperture to within one tenth wavelength of an operating frequency center.

9. The method of claim 1, wherein the step of providing a waveguide includes providing a waveguide channel having narrow dimension waveguide walls and a broad dimension base waveguide wall connected therebetween, the waveguide channel having a waveguide short circuit wall located along the channel, the narrow dimension waveguide walls being coupled with the ground plane to provide a broad dimension top waveguide wall for the waveguide.

10. The method of claim 9, wherein the waveguide is connected to the waveguide short circuit wall by a waveguide channel section having tapering narrow dimension waveguide walls for impedance matching the aperture through both the waveguide wall and the ground plane with the waveguide.

11. The method of claim 1, wherein the ground plane is bonded to the waveguide wall using a conductive adhesive.

12. The method of claim 1, wherein the waveguide wall is in at least ohmic contact with the corresponding ground plane of the strip transmission line at least around each aperture.

13. The method of claim 1, wherein the waveguide is reactively terminated at two ends to form a resonant cavity.

14. A method for impedance-coupling a strip transmission line to a waveguide transmission line to form a coupled-impedance network, comprising the steps of:

providing a strip transmission line having a conductive strip separated from a corresponding ground plane by dielectric therebetween;

establishing a waveguide on an opposite side of the corresponding ground plane from the conductive strip to be within one tenth wavelength of an operating frequency center of the corresponding ground plane substantially around an aperture location proximate to the strip transmission line; and disposing an aperture through a waveguide wall and through the corresponding ground plane at the aperture location, while retaining dielectric between the proximate conductive strip and the aperture.

15. The method for impedance-coupling of claim 14 wherein a first point on the strip transmission line is a first port to the coupled impedance network and a first point on the waveguide is a second port to the coupled impedance network.

16. The method for impedance-coupling of claim 15 wherein a second point on the strip transmission line is a third port to the coupled impedance network, and a second point on the waveguide is a fourth port to the coupled impedance network.

17. The method for impedance-coupling of claim 16 wherein the third port and the fourth port of the coupled impedance network are both terminated such that electromagnetic power is transferred between the strip transmission line and the waveguide with less than 1 dB power loss.

18. The method for impedance-coupling of claim 14 wherein the step of disposing an aperture includes disposing a plurality of apertures, each aperture in at least ohmic contact with the corresponding ground plane of the strip transmission line proximate the aperture.

19. The method for impedance-coupling of claim 14 wherein the step of providing a strip transmission line includes providing a plurality of strip transmission lines; and the step of disposing an aperture includes disposing an aperture proximate each strip transmission line, the aperture extending through the corresponding ground plane and waveguide wall;

such that the coupled-impedance network formed thereby has at least six ports.

20. The method for impedance-coupling of claim 14 wherein the waveguide wall and the corresponding ground plane of the strip transmission line are in at least ohmic contact substantially around each aperture.

21. The method for impedance-coupling of claim 14 wherein the waveguide wall and the corresponding ground plane of the strip transmission line are bonded with conductive adhesive around each aperture.

22. The method for impedance-coupling of claim 14 wherein the waveguide is reactively terminated on two ends to form a resonant cavity.

23. A coupler to couple high frequency electromagnetic energy from a strip transmission line, which includes a conductive strip separated from a ground plane by a dielectric therebetween, to a waveguide transmission line which is disposed opposite the ground plane from the conductive strip, the coupler comprising:

a terminating impedance of the strip transmission line;

a terminating impedance of the waveguide transmission line; and a plurality of apertures through the waveguide transmission line and through the ground plane of the strip transmission line, the apertures being at aperture locations proximate to the conductive strip;

wherein the waveguide is in conductive ohmic contact with the corresponding ground plane substantially around each aperture.

24. The coupler of claim 23, wherein the waveguide wall forms the ground plane of the strip transmission line at least adjacent to at least one aperture.

25. The coupler of claim 23, wherein the waveguide is reactively terminated on two ends to form a resonant cavity.

26. The coupler of claim 23, including a plurality of additional strip transmission lines, each having a conductive strip separated from a corresponding ground plane, and at least one additional aperture through the waveguide and through the corresponding ground plane for each conductive strip of the additional strip transmission lines.

27. The coupler of claim 23, wherein distances from the aperture locations to the strip transmission line terminating impedance and to the waveguide terminating impedance are not more than a half-wavelength of an operating center frequency.

28. The coupler of claim 23, wherein the waveguide has a waveguide channel having waveguide walls and a base waveguide wall connected therebetween, the waveguide channel having a waveguide short circuit wall located along the channel, the waveguide walls being coupled with the ground plane to provide a top waveguide wall for the waveguide.

29. The coupler of claim 28, wherein the waveguide is connected to the waveguide short circuit wall by a waveguide channel section having tapering dimension waveguide walls for impedance matching the plurality of apertures with the waveguide.

30. The coupler of claim 28, wherein the waveguide walls are bonded to the ground plane by a conductive adhesive.

31. The coupler of claim 28, wherein the waveguide channel is disposed in a support block and the strip transmission line separated from the ground plane by a dielectric therebetween is mounted in the support block, thereby forming the top waveguide wall.

32. The coupler of claim 31, further comprising a foam dielectric mounted onto the strip transmission line in the support block and a support block cover fastened to the support block to sandwich the foam dielectric between the support block cover and the strip transmission line in the support block.

* * * * *